US006513167B1

(12) United States Patent
Cheng

(10) Patent No.: US 6,513,167 B1
(45) Date of Patent: Feb. 4, 2003

(54) HEADBAND ASSEMBLY

(76) Inventor: Chen-An Cheng, No. 33, Lane 340, Section 1, Hai Tian Road, Tainan (TW)

( * ) Notice: Subject to any disclaimer, the term of this patent is extended or adjusted under 35 U.S.C. 154(b) by 0 days.

(21) Appl. No.: 10/219,307

(22) Filed: Aug. 16, 2002

(51) Int. Cl.[7] ..... A42B 1/00
(52) U.S. Cl. ..... 2/171; 2/209.13
(58) Field of Search ..... 2/171, 209.13, 2/DIG. 11; 132/212, 275, 278, 282, 273; D28/39, 41

(56) References Cited

U.S. PATENT DOCUMENTS 5,901,381 A * 5/1999 Nelson ..... 2/209.13
5,946,728 A * 9/1999 Tane ..... 2/171
6,024,102 A * 2/2000 Huang ..... 132/273
6,047,709 A * 4/2000 Tu ..... 132/275
6,289,903 B1 * 9/2001 Haufler ..... 132/275
6,382,218 B1 * 5/2002 Cheng ..... 132/275

* cited by examiner

*Primary Examiner*—John J. Calvert
*Assistant Examiner*—Katherine Moran
(74) *Attorney, Agent, or Firm*—Rosenberg, Klein & Lee

(57) ABSTRACT

A headband assembly includes a main body of the headband, several sliding bases, several elastic stems, several ornamental blocks and a decorative strap. Each sliding base has two hooks respectively formed on both sides and a post provided on the top. Each elastic stem has an inserting section formed at the top portion, and each ornamental block has a sleeve provided on the bottom. The decorative strap is provided with decoration on the circumference. The headband assembly can be easily and rapidly assembled and allow for rapid replacement, removal of alternate ornamental blocks, so as for the headband to look vivid and beautiful.

1 Claim, 3 Drawing Sheets

HEADBAND ASSEMBLY

BACKGROUND OF THE INVENTION

1. Field of the Invention

This invention relates to a headband assembly and, more particularly, to a headband assembly which is provided with movable and replaceable ornamental blocks and a decoration strap. Each ornamental block is secured to the top end of an elastic stem standing on the top surface of the headband, so as to make the headband assembly look vivid and beautiful.

2. Description of the Related Art

A conventional headband has a one-piece main body, and an ornamental block is attached firmly to the main body by glue so that the ornamental block can not be detached from the main body. Therefore, a wearer must buy a plurality of headbands with different ornamental blocks for uses in different occasions. This is not only expensive, but the plurality of headbands may present a storage problem. Besides, the conventional headband looks stiff, plain and dull because the ornamental block is firmly glued on the main body.

Therefore, another kind of headband 10 provided with an movable ornamental block 20, referring to FIGS. 1 and 2, has been invented. The headband 10 has a pair of protruding ears 101 standing on the top surface of the main body, and a lateral through hole 102 is provided in the center of each protruding ear 101. On the inner wall of each through hole 102 is circularly provided with spaced catching flanges 103. The ornamental block 20 has a pivotal axle 201 provided at the bottom, so as for both ends of the pivotal axle 201 to be respectively inserted into both through holes 102 of protruding ears 101, and on both ends of the pivotal axle 201 are provided with several positioning teeth 202, so as to be engaged with catching flanges 103 of the through holes 102. While being used, the ornamental block 20 can be moved to adjust a preferable slant degree.

However, there are many drawbacks in the above-mentioned conventional headband assembly. The protruding ears are fixed on the surface of the main body of the headband and not movable, and it is not convenient to replace different ornamental blocks. Furthermore, the ornamental block can only be moved to a single direction and a limited range of slant degrees. It still looks stiff, plain and dull.

SUMMARY OF THE INVENTION

In view of the drawbacks of the prior art mentioned above, the present invention is directed to a headband assembly that can substantially obviate the drawbacks of known ornamental implements and enhance the aesthetic effects beyond those of conventional headbands.

An object of the present invention is to provide a headband assembly having several top ornamental blocks which are easily assembled or replaced and a decorative strap on the surface of the headband, so as for the headband to look vivid and beautiful.

Another object of the present invention is to provide a headband assembly having several sliding bases which movably mount on the headband.

Yet another object of the present invention is to provide a headband assembly having several elastic stems which are provided to stand on the sliding bases and to support the ornamental blocks and are sufficiently flexible, so as to allow an oscillation of the ornamental blocks responsive to movement of a wearer's head.

Accordingly, a headband assembly in the present invention includes a main body of the headband, several sliding bases, several elastic stems, several ornamental blocks and a decorative strap. Each sliding base has two hooks respectively formed on both sides and a post provided on the top. Each elastic stem has an inserting section formed at the top portion, and each ornamental block has a sleeve provided on the bottom. The decorative strap is provided with decoration on the circumference. The headband assembly can be easily and rapidly assembled and allow for rapid replacement, removal of alternate ornamental blocks, so as for the headband to look vivid and beautiful.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
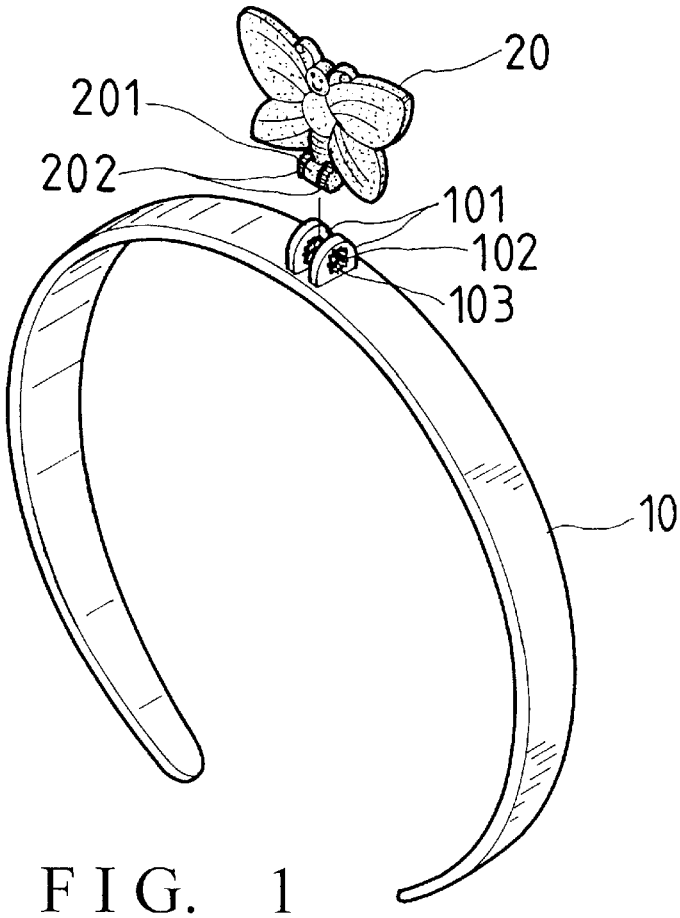
FIG. 1 (PRIOR ART)
FIG. 1 is a perspective exploded view of a conventional headband assembly.
Figure 2:
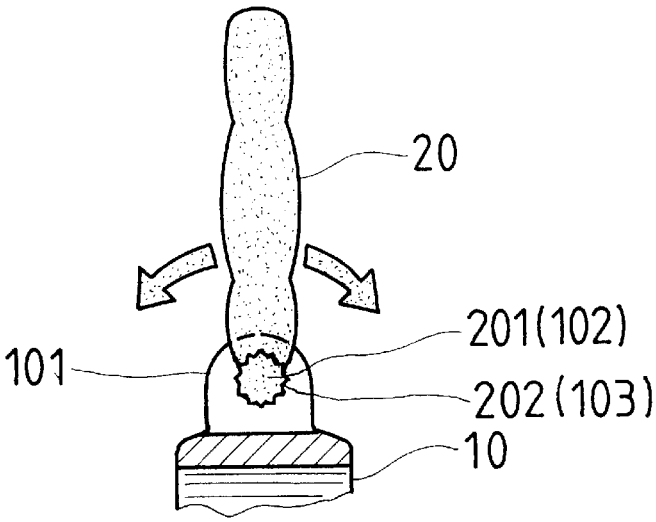
FIG. 2 (PRIOR ART)
FIG. 2 is a schematic sectional view of the conventional headband assembly in assembled configuration.
Figure 3:
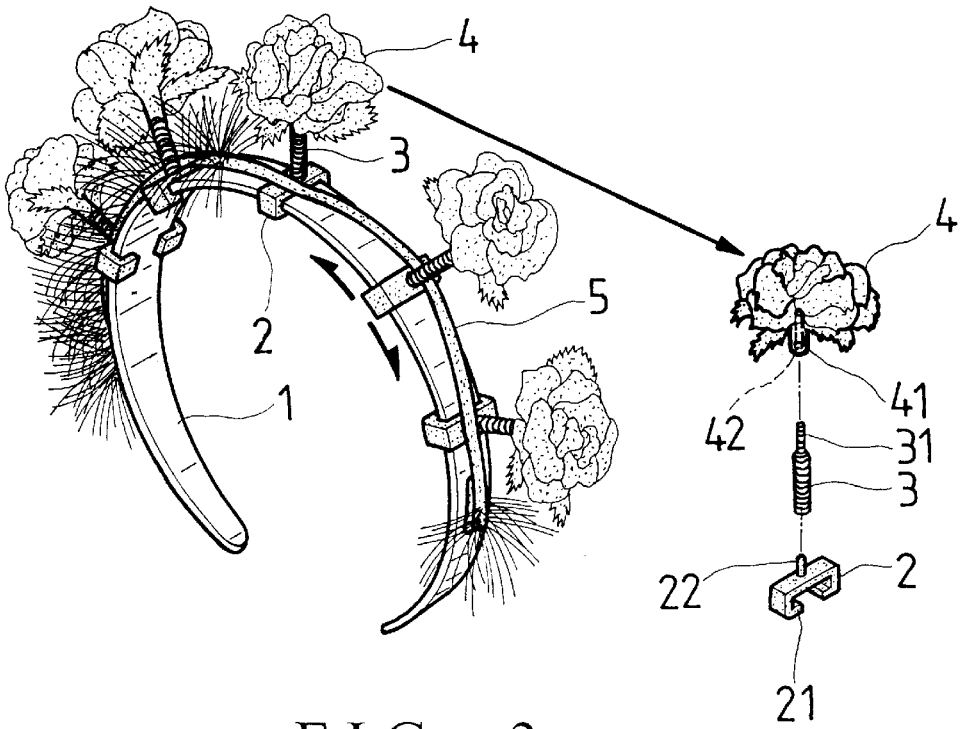
FIG. 3 is perspective exploded view of a preferred embodiment of the headband assembly in the present invention.

First, referring to FIG. 3, a headband assembly in the present invention includes a main body of the headband 1, several sliding bases 2, several elastic stems 3, several ornamental blocks 4 and a decorative strap 5.

Each sliding base 2 has a pair of hooks 21 respectively formed on both sides and a post 22 provided on the top. Each elastic stem 3 has an inserting section 31 formed at the top portion. Each ornamental block 4 has a sleeve 41 provided on the bottom, and each sleeve 41 has an interior room 42. The ornamental blocks 4 may be various kinds of configuration, referring to FIG. 5. The decorative strap 5 is provided with decoration on the circumference.

Figure 4:
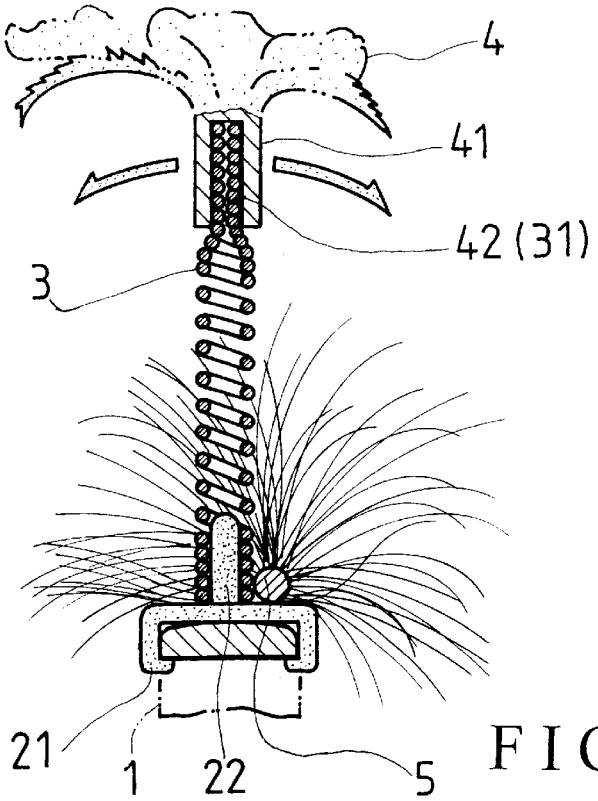
FIG. 4 is a schematic sectional view of a preferred embodiment of the headband assembly in assembled configuration in the present invention.
Figure 5:
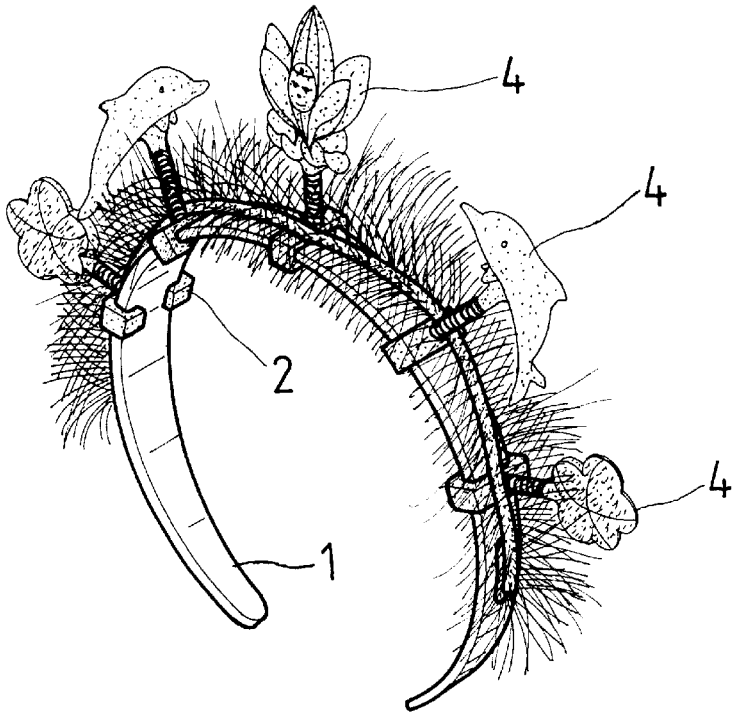
FIG. 5 is a perspective view of a preferred embodiment of the headband assembly in assembled configuration in the present invention; and, FIG. 6 is a perspective view of another preferred embodiment of the headband assembly in assembled configuration in the present invention.
Figure 6:
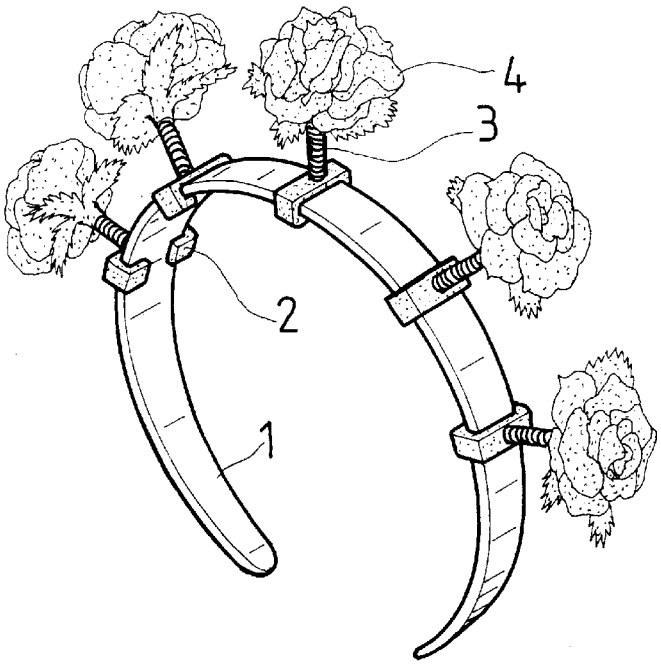

While being assembled, referring to FIGS. 4,5 and 6, each sliding base 2 is penetrated by the main body of the headband 1, so as to movably mount on the headband 1 by means of each pair of hooks 21 formed on both sides of each sliding base 2. The bottom portion of each elastic stem 3 is securely coupled to each post 22 provided on the top of each sliding base 2, and each inserting section 31 of each elastic stem 3 is inserted into the interior room 42 of each sleeve 41 provided on the bottom of each ornamental block 4. Finally, the decorative strap 5 may be alternated to secure to the surface of the main body of the headband 1, so as to finish assembly.

Referring to FIG. 5, a wearer can alternatively choose various configuration of ornamental blocks 4 to make the headband assembly look more beautiful, and each sliding base 2 can be moved to adjust a preferred position, referring to FIG. 3. While the headband assembly being worn on a wearer's head, several elastic stems 3 standing on the sliding bases 2 and supporting the ornamental blocks 4 are sufficiently flexible, so as to allow oscillation of the ornamental blocks 4 responsive to the movement of a wearer's head.

While the preferred embodiments of the invention have been described above, it will be recognized and understood that various modifications may be made therein, and the appended claims are intended to cover all such modifications which may fall within the spirit and scope of the invention.

What is claimed is:

1. A headband assembly comprising:

a main body of a headband, being provided for a wearer to wear on the head;

a plurality of sliding bases being provided to movably mount on said main body of said headband, each said sliding base having a pair of hooks respectively formed on both sides, a post provided on the top of each said sliding base;

a plurality of elastic stems being sufficiently flexible and provided to respectively stand on said sliding bases and support ornamental blocks, each said elastic stem having an inserting section formed at the top portion;

a plurality of ornamental blocks being respectively provided on the tops of said elastic stems, each ornamental block having a sleeve provided on the bottom, each said sleeve having an interior portion, said ornamental blocks providing for various configurations; and, a decorative strap provided for securement on the surface of said main body of said headband.

* * * * *